United States Patent [19]

Sommerhauser et al.

[11] Patent Number: 4,979,457

[45] Date of Patent: Dec. 25, 1990

[54] SUPPORT APPARATUS FOR A PROTECTIVE COVERING AND THE LIKE

[75] Inventors: Peter M. Sommerhauser, 7421 N. Crossway Rd., Fox Point, Wis. 53217; John L. Beard, Shorewood; George G. Grigel, Grafton, both of Wis.

[73] Assignee: Peter M. Sommerhauser, Fox Point, Wis.

[21] Appl. No.: 404,659

[22] Filed: Sep. 8, 1989

[51] Int. Cl.[5] ..... B63B 17/00

[52] U.S. Cl. ..... 114/361; 114/201 R; 135/88

[58] Field of Search ..... 296/100, 101, 138; 248/231.7; 114/201 R, 203, 343, 349, 361; 135/88, 100, 101, 901; 441/38; 403/52, 53, 62, 63, 83, 87, 110

[56] References Cited

U.S. PATENT DOCUMENTS

| | | | |
|---|---|---|---|
| 270,448 | 1/1883 | Mallory | 114/361 |
| 811,322 | 1/1906 | Poltock | 114/361 |
| 1,878,393 | 9/1932 | Grier | 114/361 |
| 3,001,212 | 9/1961 | Towne | 114/361 |

*Primary Examiner*—Joseph F. Peters, Jr.
*Assistant Examiner*—Clifford T. Bartz
*Attorney, Agent, or Firm*—Godfrey & Kahn

[57] ABSTRACT

A support apparatus for positioning a protective cover in a predetermined substantially sheltering attitude relative to an open cockpit of a watercraft, the support apparatus including a plurality of adjustable support members which are positioned in supporting relation relative to the cockpit, and which are individually operable to maintain the protective covering in a predetermined sheltering attitude relative to the open cockpit.

18 Claims, 2 Drawing Sheets

SUPPORT APPARATUS FOR A PROTECTIVE COVERING AND THE LIKE

BACKGROUND OF THE INVENTION

1. Field of the Invention:

The present invention relates to a support apparatus for positioning a protective covering in a predetermined covering attitude relative to an open cockpit of a watercraft and the like, and more particularly to such a device which is adapted to position a protective covering in an attitude whereby the cockpit of the watercraft and subjacent portions thereof are protected from the environment while serving a variety of other functions.

2. Description of the Prior Art:

The deterioration of watercraft components due to the damaging effects of repeated and prolonged exposure of same to the effects of sunlight and other environmental influences, such as rain, and snow, have long been known. For example, upholstery and other protective surfaces covering the interior walls of a cockpit of a watercraft tend to fade, discolor, or crack following prolonged exposure to direct sunlight, as well as to the effects of prolonged exposure to moisture, unless afforded some form of protection. It has also long been known that exposure to direct sunlight or prolonged exposure to even weak or diffuse sunlight can cause the dashboard and related console areas of a watercraft to discolor or crack, such cracking being due in part to the often dramatic increases in surface temperatures resulting from absorption of light energy. Further, exposure to moisture for long periods of time encourages the growth of mold and mildew and causes materials to become weakened. Over extended periods of time such sunlight and water related damage often necessitates expensive repair and/or replacement of the affected areas of the watercraft. Further, if the environmentally damaged areas are not repaired or the components replaced, a diminution of both the aesthetic and market value of the watercraft results.

Attempts made in the prior art to protect the open cockpit of a watercraft and more particularly the dashboard, related console areas, upholstered seats and carpeted decks, from such damage have assumed various forms. For instance, many owners and operators of watercraft place opaque objects such as towels or the like upon the dashboards or over the seats in an attempt to decrease the infiltration of harmful rays of sunlight during the summer months. In many instances, a custom made boat cover is purchased and which is adapted to fit over the open cockpit. In many instances, however, these boat covers are not available or after they are unserviceable cannot be replaced except at great expense.

Other attempts in the prior art to provide protective devices for the cockpits of watercraft have included ridge pole assemblies such as that illustrated in U.S. Letters Pat. No. 3,106,931 to Cooper and which relates to a portable telescopic adjustable boat cover ridge pole that supports a boat ) cover in covering relation over the boat. Further, and as illustrated most clearly by U.S. Pat. No. 4,641,600 to Halverson, other inventors have approached the problem of covering boats by providing a rolling boat cover which is extendable and retractable relative to the cockpit from a roller that is disposed across the transom of the boat.

While some of the prior art devices have operated with varying degrees of success, they are unsatisfactory in one or more respects. For example, some of these devices are cumbersome, not reliably retained in position and do not admit to convenient compact storage in the watercraft when not operably deployed. Others either do not cover all the areas to be protected or are oversized and thus unsightly in use. Further, some of the aforementioned devices must either be permanently installed upon the watercraft or require specially adapted mounting mechanisms. Yet another deficiency common among the prior art devices is that water and snow collects in pools on the assorted protective coverings thereby weakening them over prolonged periods of time, with the resultant effect that leaks occur and the interior of the cockpit is damaged. Yet another deficiency common among the prior art mechanisms is their inability to be manufactured and sold at a relatively inexpensive price.

The economic impact of watercraft damage caused by sunlight and other environmental influences is but one of many financial aggravations which may confront a watercraft owner. Another source of financial hardship commonly encountered is the theft of assorted watercraft equipment and other personal effects, such as fishing equipment, and the like, many of which are customarily left in the cockpit of a watercraft when they are tied up to public landings or docks and thus are readily viewable from the exterior of the watercraft.

The deterrence of theft of such equipment may entail such costly and inconvenient measures as the installation of lock boxes or an alarm system or the securing of such personal effects in remote locations with respect to the watercraft.

Therefore, it has long been known that it would be desirable to have a support apparatus for positioning a protective covering in a predetermined covering attitude relative to an open cockpit of a watercraft and which is capable of protecting the cockpit area of the watercraft and subjacent areas from damage due to exposure to sunlight or other environmental influences, such as water and snow, and which further aids in the deterrence of theft and which is capable of performing a variety of secondary functions, the device being both inexpensive to manufacture and sell and capable of compact storage.

OBJECTS AND SUMMARY OF THE INVENTION

Therefore, it is an object of the present invention to provide an improved support apparatus for positioning a protective covering in sheltering relation relative to an open cockpit of a watercraft or the like.

Another object of the present invention is to provide such a support apparatus for a watercraft having a dashboard and subjacent console and which is adapted to be mounted so as to substantially protect such assemblies and closely adjacent areas within the cockpit of the watercraft.

Another object of the present invention is to provide such a support apparatus which is adapted to position a protective covering in such an attitude that damage to structures covered thereby from exposure to sunlight and other environmental influences is substantially eliminated.

Another object of the present invention is to provide such a support apparatus for positioning a protective cover in sheltering relation relative to an open cockpit of a watercraft and which is adapted to be constructed so as to adjustably conform to the length dimension of the open cockpit and which further can detachably and rapidly be secured in covering relation thereto.

Another object of the present invention is to provide such a support apparatus which is capable of being deployed in an operable configuration suitable for supporting a protective covering in a relatively short period of time.

Another object of the present invention is to provide such a support apparatus for a protective covering which causes water coming in contact with the protective covering to drain from same while the apparatus is operably deployed.

Another object of the present invention is to provide such a support apparatus which, when supporting a protective covering in sheltering relation relative to an open cockpit of a watercraft, is adapted substantially to eliminate the risk of damage to areas of the cockpit which might otherwise be caused by the effects of sunlight or other environmental influences such as water acting upon these same areas.

Another object of the present invention is to provide such a support apparatus for a protective covering which is characterized by ease of deployment, simplicity of construction, and which can be sold at a nominal price.

Further objects and advantages are to provide improved elements and arrangements thereof in an apparatus for the purposes described which is dependable, economical, durable and fully effective in accomplishing its intended purposes.

These and other objects and advantages of the present invention are achieved in a support apparatus for positioning a protective covering in a predetermined substantially covering attitude relative to an open cockpit of a watercraft, the watercraft having a windscreen frame and a transom, the support apparatus comprising, a plurality of adjustable support members which have opposite ends and which individually rest on the windscreen frame and the transom respectively, the protective covering resting on said support members and thereby positioned in covering relation relative to the open cockpit, and a yoke borne by the support members and having a plurality of apertures corresponding in number to the support members and dimensioned slidably and matingly to receive the individual support members, the yoke operable to fixedly position and interconnect the individual support members in predetermined spaced relation, respectively.

DESCRIPTION OF THE PREFERRED EMBODIMENT

Figure 1:
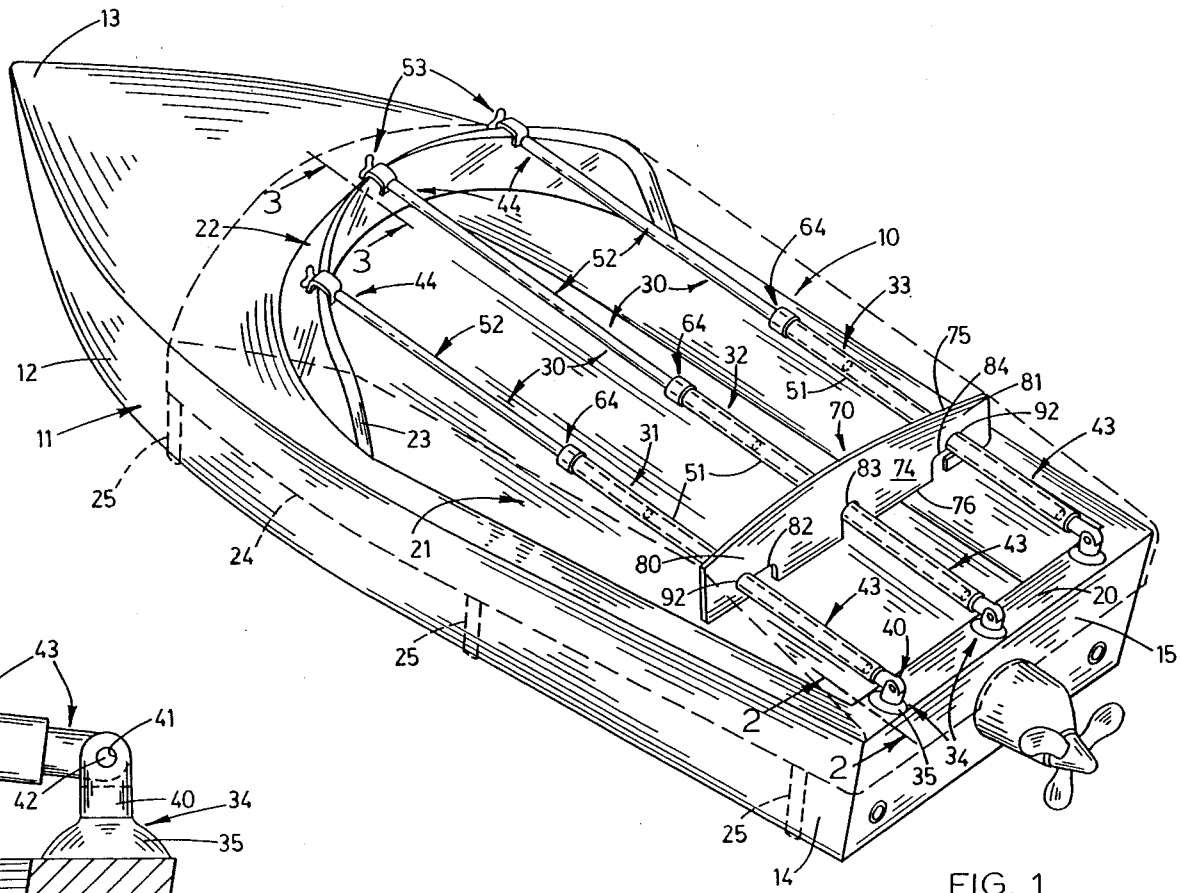
FIG. 1 is a perspective side elevation view of the support apparatus embodying the principles of the present invention shown in a typical operative environment.
Figure 2:
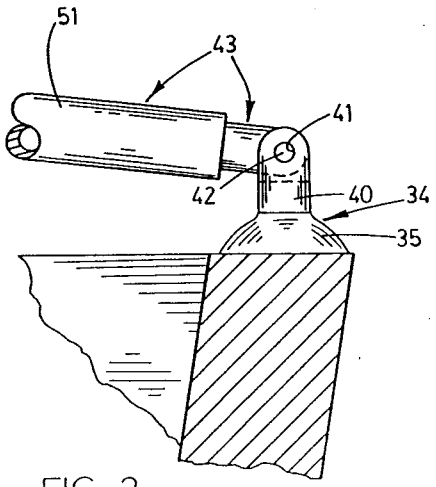
FIG. 2 is a partial, longitudinal, vertical sectional view taken from a position along line 2—2 of FIG. 1.

Referring more particularly to the drawings, the support apparatus embodying the principles of the present invention is designated generally by the numeral 10 in FIG. 1. As illustrated therein, the support apparatus 10 is shown in an operably deployed configuration on a watercraft 11 which includes a hull 12 which defines a bow 13, a rearwardly disposed stern 14 which includes a transom 15, and a gunwale 16 which is positioned on both the port and starboard sides of the watercraft. As best illustrated by reference to FIG. 2, the transom has a substantially horizontally disposed upper surface 20. The hull 12 defines a cockpit 21 and a windscreen 22 is mounted in a suitable fashion on the bow end of the cockpit. The windscreen 22 is held in place by a peripherally positioned windscreen frame 23. The apparatus 10 supports a boat covering 24 in a predetermined covering attitude relative to the open cockpit 21. The boat cover 24 may further have straps 25 which may be passed under the hull and secured to the straps on the opposite side, not shown, when the boat is placed in storage.

A plurality of adjustable support members which are generally indicated by the numeral 30 include first, second and third support members 31, 32 and 33, respectively. The individual support members are disposed in an attitude which is substantially parallel to the longitudinal axis of the watercraft 11. A base member, which is generally indicated by the numeral 34, is operable to support the individual support members 31 through 33, respectively, on the upper surface 20 of the transom 15. The base member includes a resilient frustoconically-shaped member 35 which may take on the form of a suction cup. Fixed to the resilient member 35 is a pair of rigid posts 40. The pair of rigid posts are positioned in predetermined spaced relation, one to the other. Further, each of the posts has an aperture 41 which are respectively adapted to receive a pivot pin 42.

Figure 3:
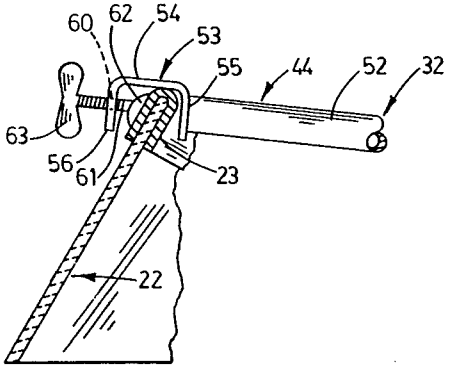
FIG. 3 is a partial, longitudinal, vertical sectional view taken from a position along line 3—3 of FIG. 1.

The first, second and third support members 31, 32 and 33, respectively, have a first end 43 and an opposed seCond end 44. The first end 43 has an aperture formed therein, not shown, whereby the first end can be positioned between the posts 40 and the apertures 41 and the aperture formed in the first end 43 can be so aligned such that the pivot pin 42 can be slidably received therethrough thereby rendering the individual support members pivotable about the base. This relationship is clearly shown in FIG. 2. The individual support members further have elongated, substantially cylindrically shaped first portions 51 which are adapted telescopingly to receive elongated, substantially cylindrically shaped second portions 52. Further, a mounting fixture, which is generally indicated by the numeral 53, is secured by a suitable fastener or by welding, or the like, to the second end 44 of each of the support members 31 through 33, respectively. The respective mounting fixtures 53 include a substantially U-shaped frame 54 which has a first leg 55 which is secured to the second end 44 of each of the support members, and an opposite second leg 56 which is spaced therefrom. As best illustrated by reference to FIG. 3, a threaded passageway 60 is formed in the second leg 56 and is adapted to receive a threaded shaft 61. The threaded shaft mounts a moveable engagement member 62 in a suitable ball and socket arrangement, not shown, and a hand-adjustable head member 63 is fixed to the opposite end of the threaded shaft and is operable to be manipulated so as to impart selective rotational movement to the threaded shaft thereby permitting the threaded shaft to be selectively advanced towards, or away from, the windscreen 22.

An adjustment member 64 is mounted on the first portion 51 of the individual support members 30 and is operable to fixedly secure the respective first and second portions in a predetermined position one to the other thereby permitting the individual support members to be adjusted as to length so as to be able to fit boats of various lengths. It should be understood that when the apparatus 10 is not in use the support members can be telescoped, one inside the other, and thereafter secured in a suitable storage bag, not shown, on the watercraft. As best illustrated by reference to FIG. 1, the respective mounting fixtures 53 are positioned in substantially equally spaced relation along the peripheral windscreen frame 23, with the second support member 32 being disposed substantially along the longitudinal axis of the watercraft. As should be understood by a study of FIG. 1, the windscreen 22 and more particularly the peripheral frame supporting same 23, is substantially arcuately shaped with the central portion thereof being slightly higher than those portions spaced laterally therefrom. As a result, the second support member 32, as a general matter, will be positioned in an attitude slightly higher than the first and third support members, respectively. As a result, the boat cover 24 will be positioned in an advantageous attitude whereby water in the form of rain or melted snow will be encouraged to drain off of the boat cover, thereby preventing it from accumulating into stagnant pools where it may have the effect of weakening the cover or otherwise possibly leaking to the inside of the cockpit where it could potentially cause damage.

Figure 4:
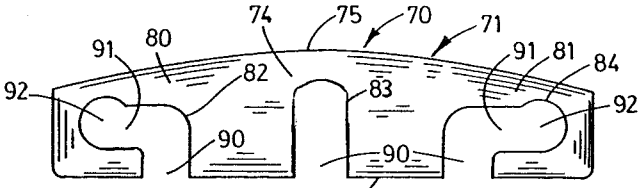
FIG. 4 is a side elevation view of a first embodiment of a yoke member of the subject invention.
Figure 5:
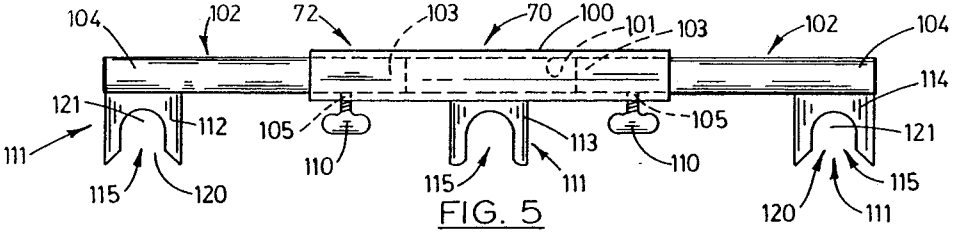
FIG. 5 is a side elevation view of a second embodiment of a yoke member of the subject invention.
Figure 6:
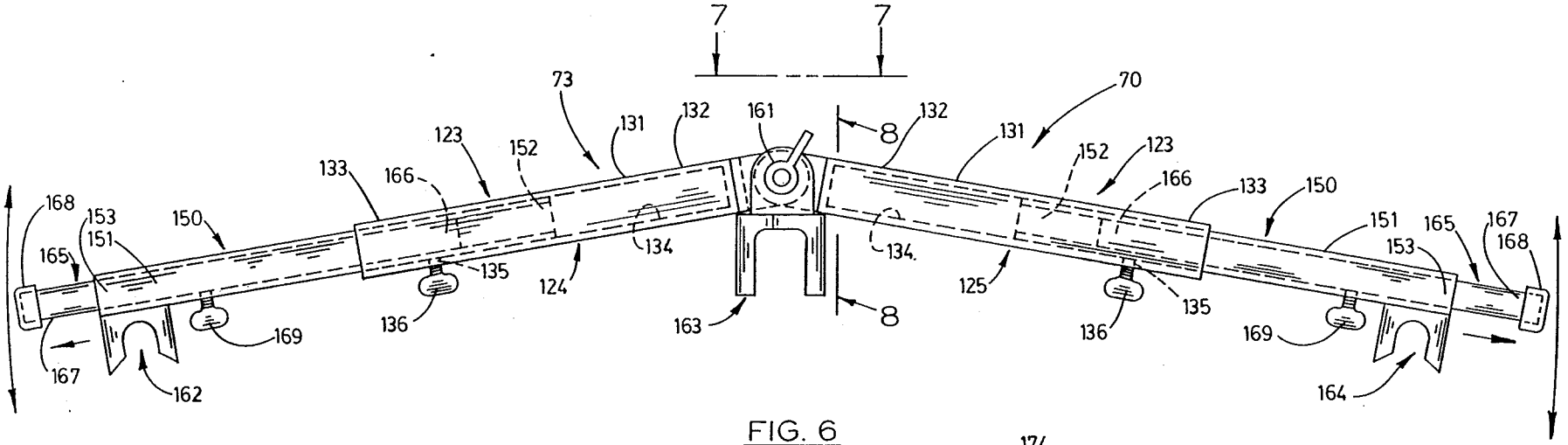
FIG. 6 is a side elevation view of a third embodiment of a yoke member of the subject invention.

As best understood by a study of FIGS. 4, 5 and 6, several variations of a yoke assembly are generally indicated by the numeral 70 and which alternatively can be used to practice the present invention. The first yoke 71 is adapted to releasably interconnect each of the support members 31, 32 and 33 and thereby fixedly position them in predetermined substantially equally spaced relation. For convenience, the first yoke will be described in detail and the second and third yokes 72 and 73, respectively, will be described in the paragraphs which follow.

The main body 74 of the first yoke 71 has an arcuately shaped top edge 75, a bottom edge 76, and left and right portions which are generally indicated by the numerals 80 and 81, respectively. The first yoke includes first, second and third apertures 82, 83 and 84, respectively, each of the apertures having a substantially vertical component 90, and the first and third apertures 82 and 84 having a substantially horizontal component 91. Further, and as best illustrated by reference to FIG. 4, the main body 74 further defines a pair of substantially arcuately shaped seats 92 which are respectively positioned endwardly of the horizontal components 91 and which are shaped so as to matingly receive the first and third support members 31 and 33, respectively. The second aperture 83 has a vertical component which has a length dimension which is substantially longer relative to the vertical components of the first and third apertures, respectively. The length of the second aperture is provided so as to permit the first yoke to be employed on watercraft having variously dimensioned windscreen frames which may have a somewhat higher central portion relative to the outboard portions thereof. In operation, the first, second and third support members are positioned and secured in the manner shown in FIG. 1 to the windscreen frame and the yoke is then positioned to matingly receive the individual support members. The first and third support members are urged in an outward direction thereby individually positioning them in the respective arcuately shaped seats 92. In this position, the yoke is adapted to substantially fixedly maintain the first, second and third support members in predetermined spaced relation while the boat cover 24 is pulled over the support apparatus and thereafter secured utilizing the straps 25. Further, and when snow, rain or wind acts upon the cover, the yoke is operable to maintain the support members in predetermined spaced relation, distributes the weight of the rain or snow evenly among the individual support members and operates to inhibit the bending of same. Further, the yoke operates to prevent the individual support members from sliding in a direction one towards the other or off of the supporting surface of the transom.

The second yoke, which is generally indicated by the numeral 72, has an elongated substantially cylindrically shaped central portion 100. The central portion 100 defines a substantially cylindrically shaped channel or passageway 101 which is adapted telescopingly to receive a pair of cylindrically shaped and extendable legs 102. Each of the extendable legs has a proximal end 103 which is slidably and telescopingly received internally of the channel 101, and an opposite distal end 104 which is remote thereto. As best illustrated by reference to FIG. 5, a pair of threaded passageways 105 are individually formed in the central portion and disposed endwardly thereof, and which are respectively adapted to receive a pair of thumb screws 110. The individual thumb screws 110 are operable to be threadably advanced into movement inhibiting engagement relative to the individual extendable legs 102 thereby positioning them in predetermined longitudinal extending relation relative to the central portion. The second yoke has a plurality of engagement members 111 which include first, second and third engagement members 112, 113 and 114, respectively. Each of the engagement members include an aperture 115 which is adapted to receive the individual support members, 31, 32 and 33, respectively. The apertures formed in the first and third engagement members, respectively, have diminishing mouth portions 120 and interconnected receiving portions 121. The apertures formed by the first and third engagement members are adapted to "snap fit" with the first and third support members, respectively, thereby securely receiving same. The second engagement member operates in the same manner as the second aperture formed in the first yoke member and therefore for the sake of brevity is not discussed in further detail herein.

Figure 7:
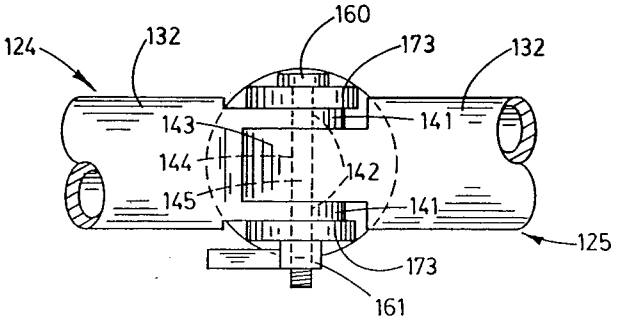
FIG. 7 is a partial, longitudinal, plan view taken from a position along line 7—7 of FIG. 6.

The third yoke member, which is generally indicated by the numeral 73, includes a pair of adjustable leg members 123 which are individually designated as a first leg member 124 and a second leg member 125. Each of the leg members 124 and 125, respectively, have a substantially cylindrically shaped first portion 131 defining a proximal end 132 and an opposite distal end 133. The first portion of each leg member defines a suitably dimensioned channel 134. Further, a pair of threaded passageways are individually formed in the distal ends 133 thereof. The threaded passageways are adapted to receive suitably dimensioned thumb screws which are threadably advanced into movement inhibiting engagement relative to a second portion 150 which will be discussed in further detail herein. The proximal end 132 of the first member 124 includes a pair of substantially parallel, spaced, support brackets 141 which extend outwardly, longitudinally, thereof. A pair of suitably dimensioned apertures 142 are individually formed in each of the support brackets and are disposed in registry one with the other. Further, a complementary support bracket 143 is mounted on or made integral with the proximal end 131 of the second member 125 and is dimensioned to be slidably received between the pair of support brackets 141 in the manner which is illustrated most clearly by reference to FIG. 7. The complementary support bracket 143 also has an aperture 144 formed therein whereby, when the complementary support bracket is appropriately positioned therebetween the pair of support brackets, the aperture 144 formed therein is disposed in substantial registry with the apertures 142 such that a suitably dimensioned threaded shaft 145 can be slidably received therethrough. The threaded shaft will be discussed in further detail hereinafter. The first portions 131 of the adjustable leg members 123 are respectively adapted to slidably and telescopingly receive individual second portions 150. The second portions 150 each have a substantially elongated and cylindrically shaped main body 151 which has a proximal end 152 which is telescopingly received in the channel 134, and an opposite distal end 153 which is remote thereto. As earlier discussed, the thumb screws 136 may be threadably advanced into movement inhibiting engagement relative to each of the second portions so as to position them in substantially fixed longitudinally extending relation relative to the associated first portion.

The threaded shaft 145 operates as a pivot point for the second yoke 73 thereby permitting the third yoke to articulate in a fashion whereby it can be adjusted to imitate the shape of the windscreen peripheral frame 23. This permits the yoke to position the individual support member in similar attitudes which imitate the shape of the peripheral frame. The threaded shaft 145 has a head 160 and a hand adjustable nut 161 is adapted to threadably engage the threaded shaft and may be advanced into movement inhibiting engagement relative to the proximal ends of the respective first and second members 124 and 125 so as to position the adjustable leg members 123 in predetermined attitudes one to the other.

The third yoke 73 includes first, second and third engagement members 162, 163 and 164, respectively, which operate in a manner substantially similar to the first and second yokes which were previously described, that is, they are operable to engage and thereby fixedly position the individual support members 31, 32 and 33 in predetermined spaced relation. In this regard, the first and third engagement members operate in the manner as previously described with respect to the second yoke and therefore for the sake of brevity are not discussed in further detail herein. However, the second engagement member 163 is mounted on the third yoke by means of the threaded shaft 145. The second engagement member will be discussed in further detail hereinafter.

The main body 151 of each of the second portions 150 are adapted slideably and telescopingly to receive individual cylindrically shaped bracing members 165. Each bracing member has a proximal end 166 which is slideably received in the channel 134, and opposite distal ends 167 which are remote thereto. Further, a resilient cap 168 is mounted on each of the distal ends. A pair of thumb screws 169 are individually threadably received through each of the second portions and are individually operable to be threadably advanced into movement inhibiting engagement relative to each of the bracing members 165 thereby positioning the individual bracing members in substantially fixed longitudinally extending relation relative to the associated first portions. In operation, the bracing members are operable to be extended such that the distal ends rest on the port and starboard gunwale 16 of the watercraft. In this position, the bracing members are operable to further support the individual support members in a proper attitude and to inhibit the bending of same under the weight of accumulated ice, snow, leaves or the like.

Figure 8:
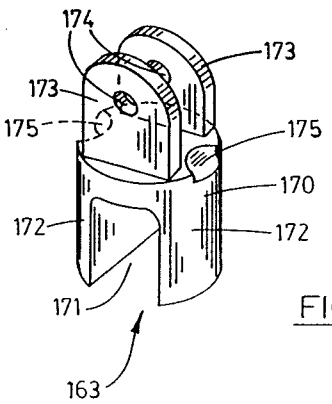
FIG. 8 is a perspective, side elevation view of an engagement member taken from a position along line 8—8 of FIG. 6.

The second engagement member 163 has a main body which is generally indicated by the numeral 170 and which defines an elongated aperture 171 which is disposed in a substantially vertical attitude. The main body includes a pair of depending legs 172 which define the aperture 171. Further, a pair of substantially vertically disposed and substantially parallel, spaced, support brackets 173 extend longitudinally, upwardly, relative to the main body 170 in the manner which is illustrated most clearly by reference to FIG. 8. A pair of apertures 174 are formed in each of the support brackets 173, the apertures disposed in substantial registry one with the other. As best illustrated by reference to FIG. 7, the pair of support brackets 173 are spaced a predetermined distance apart, such that the pair of support brackets 141 and the complementary support bracket 143 may be positioned therebetween the support brackets 173 in the manner shown. In this fashion, the threaded shaft 145 may be received through the apertures 142, 144 and 174, respectively, thereby joining the second engagement member 163 to the pair of adjustable leg members 123 in the fashion shown. An arcuately shaped depressed area 175 is formed on opposite sides of the second engagement member in the fashion shown in FIG. 8. The depressed areas are included to permit the individual adjustable legs to be articulate through a wide range of positions.

OPERATION

The operation of the described embodiment of the present invention is believed to be readily apparent and is briefly summarized at this point.

The employment of the support apparatus to position a protective covering 24 in a predetermined attitude in sheltering relation relative to an open cockpit 21 of a watercraft 11 is best understood by reference to FIG. 1. For purposes of illustrative convenience, it will be understood that the watercraft has a windscreen having a peripheral frame 23 and a rearwardly disposed transom 15 having an upwardly disposed surface 20.

The first, second and third support members 31, 32, and 33, respectively, are respectively positioned in spaced relation along the windscreen frame and are secured in fixed locations utilizing the mounting fixtures 53 in the manner which was previously described. Once secured in this location, the individual support members are extended such that the individual base members 34 rest on the upwardly disposed surface 20 of the transom 15. Once the base members are positioned in rested relation on the transom, the adjustment members 64 are hand-tightened such that the individual support members are substantially fixed as to their respective length dimension. Once this step is accomplished, one of the yokes previously described, 71, 72 or 73 is deployed or positioned to fixedly secure the individual support members in predetermined spaced relation. For example, and in the case of the first yoke 71, the individual support members are positioned in the apertures 82, 83 and 84, respectively, and the first and third support members are urged in an outward direction such that they individually come to rest in the respective arcuately shaped seats 92. Once this is accomplished, the support members are substantially inhibited against movement and the boat covering may then be stretched over the top of the support apparatus 10 and thereafter secured in a manner well understood in the art.

In similar fashion, the second and third yokes are utilized to fixedly position the support members in spaced relation but are otherwise adjustable to accommodate boats having different beam dimensions. In the case of the second yoke 72, the thumb screws 110 are released, thereby permitting substantially longitudinal movement of the individual extendable legs 102. Once appropriately positioned, the thumb screws are threadably advanced, thereby inhibiting movement of the individual adjustable leg members. The individual engagement members 111 are thereafter urged into mating receipt with the individual support members 30, thereby fixing them in predetermined spaced relationship.

Further, and in the instance of the third yoke member 73, the first and second members 124 and 125 are articulated about the pivot point which is defined by the threaded shaft 145. When appropriately positioned, the hand adjustable nut 161 is threadably advanced and tightened, thereby positioning them in an appropriate attitude. Further, the second portions 150 may be extended and secured in a predetermined longitudinal relationship relative to an associated first portion 131 by utilizing the individual thumb screws 136. In similar fashion, the individual engagement members 162, 163 and 164, respectively, are thereafter urged into mating engagement with the individual support members 30, thereby fixedly positioning them in predetermined spaced relationship.

When not deployed in a covering relationship upon a watercraft, the support apparatus can be stored in a compact configuration by telescopingly collapsing the individual support members in a fashion which is readily apparent by a study of the drawings. The apparatus can thereafter be stored in a suitable storage case or bag, not shown, and then stowed in a remote location on the watercraft or elsewhere as appropriate.

The support apparatus of the present invention can be embodied in a myriad of forms and further can be manufactured from a wide variety of materials, although it is preferable that any material employed in the construction of the support apparatus be lightweight, durable, and further be manufactured of corrosive resistant materials. Ideally, materials such as aluminum and various extrudable plastics can be employed for such purposes.

Therefore, it will be seen that the support apparatus of the present invention provides a means by which a protective covering can be advantageously positioned in sheltering relation to the watercraft and which further provides substantial protection for the open cockpit of the watercraft as well as to the dashboard and console areas and related and subjacent upholstered areas on which it is used against damage from sunlight and related environmental influences and the like and which serves the further purpose of concealing valuable personal belongings from the view of prospective thieves. The present invention also affords an apparatus which can be readily deployed when needed and which further can be compactly stored when not in use.

Although the invention has been herein shown and described in what is conceived to be the most practical and preferred embodiment, it is recognized that departures may be made therefrom within the scope of the invention which is not to be limited to the illustrative details disclosed.

Having described our invention, what we claim as new and desired to secure by Letters Patent is:

1. A support apparatus for positioning a protective covering in a predetermined attitude relative to an open cockpit of a watercraft, the watercraft having a windscreen frame and a transom, the support apparatus comprising:

a plurality of adjustable support members each having opposite ends which individually rest on the windscreen frame and the transom, respectively, the protective covering resting on each of the support members and thereby positioned in covering relation to the open cockpit, and a yoke borne by the support members and having a plurality of apertures corresponding in number to the support members and dimensioned to matingly receive the individual support members, the yoke operable to fixedly position and interconnect the individual support members in predetermined spaced relation, respectively.

2. A support apparatus as claimed in claim 3 wherein three support members are provided and each of the support members has a longitudinal axis and is longitudinally adjustable as to length, and wherein each of the support members has a first end which rests on the transom of the boat and which has an opposite second end which is releasably secured to the windscreen frame, and wherein longitudinal adjustment means are provided for releasably fixing the length dimension of the respective support members.

3. A support apparatus as claimed in claim 2 wherein a base member is pivotally mounted on the first end of each of the support members and is adapted to rest on the transom of the boat, and wherein the second end of each support member includes means which releasably secures said respective second ends on the windscreen frame.

4. A support apparatus as claimed in claim 3 wherein the securing means includes a substantially U-shaped frame having a pair of legs and wherein one of the legs is fixed on the second end of each of the respective support members, and wherein individual threaded members are respectively threadably received through the other leg of each frame, and wherein the respective threaded members are operable to releasably engage the windscreen frame thereby capturing the windscreen frame between the respective threaded members and the second end of the respective support members.

5. A support apparatus as claimed in claim 4 wherein the yoke has an elongated main body with a bottom edge and left and right sides, and wherein first, second and third apertures extend through the bottom edge, and wherein the left and right sides of the main body define individual apertures having both a vertically disposed component and a horizontally disposed component, and wherein the horizontally disposed component of each of the apertures is oriented in an outward direction.

6. A support apparatus as claimed in claim 4 wherein the yoke is adjustable as to length and has a central portion which is adapted telescopingly to receive a pair of extendable legs, and wherein the extendable legs each have a proximal end which is slidably received in substantially telescoping relation relative to the central portion, and a distal end, and wherein an engagement member is mounted on the distal end of each of the extendable legs and substantially centrally of the central portion, the individual engagement members operable to releasably engage the individual support members thereby positioning the support members in predetermined spaced relation, and wherein securing means is borne by the central portion and is operable to releasably position said respective extendable legs in predetermined fixed longitudinal relation relative to the central portion.

7. A support apparatus as claimed in claim 4 wherein the yoke includes a pair of adjustable leg members each having a first portion with respective proximal and distal ends, and wherein a pair of second portions individually telescopingly mate with each of the first portions, and wherein a pair of bracing members individually telescopingly mate with each of the second portions, and wherein the respective proximal ends of the first portions are pivotally joined together at a pivot point, and wherein individual engagement members are individually mounted on the second portion of each of the adjustable legs and at the pivot point, and wherein an articulation adjustment means is borne by the yoke and is operable to releasably position the respective adjustable leg members in a predetermined fixed attitude relative one to the other, and wherein securing means is borne by each of the leg members and is operable to releasably position the respective second portions and bracing members in predetermined fixed substantially longitudinal relation relative to the associated first and second portions.

8. A support apparatus as claimed in claim 6 wherein the securing means includes a pair of thumb screws which are screw threadably received through the central portion and which respectively engage the individual extendable legs thereby releasably securing them in predetermined fixed longitudinally extending relation relative to the central portion.

9. A support apparatus as claimed in claim 4 wherein the articulation adjustment means includes a threaded post about which the individual adjustable leg members pivot and a hand adjustable nut member screw-threadably engages the threaded post thereby securing the individual adjustable legs in a predetermined fixed attitude one to the other, and wherein the securing means includes a pair of thumb screws which are individually threadably received through each of the first and second portions and which individually engage the respective second portions and bracing members thereby releasably securing the individual second portions and bracing members in predetermined fixed longitudinally extending relation relative to the associated first and second portions.

10. A support apparatus for positioning a protective covering in a predetermined substantially covering attitude relative to an open cockpit of a watercraft, the watercraft having a windscreen frame and a transom, the support apparatus comprising:

a first adjustable support member having a first end borne by the transom of the watercraft and an opposite second end which is releasably secured in a predetermined position on the windscreen frame, a second adjustable support member having a first end borne by the transom of the watercraft and which is positioned in spaced relation relative to the first end of the first adjustable support member, and a second end which is releasably secured on the windscreen and which is disposed in spaced relation relative to the second end of the first adjustable support member, a third adjustable support member having a first end borne by the transom of the watercraft and which is positioned in spaced relation relative to first end of the second adjustable support member, and a second end which is releasably secured in a predetermined position on the windscreen frame and which is positioned in spaced relation relative to the second end of second adjustable support member, means mounted on the second end of each of the adjustable support members for releasably securing the respective second ends of the support members on the windscreen frame, and a yoke adapted to releasably interconnect each of the support members and having a main body with first, second and third apertures which are individually dimensioned to matingly engage the respective support members thereby fixedly positioning them in individually predetermined spaced relation.

11. A support apparatus as claimed in claim 10 wherein longitudinal adjustment means are provided for fixedly adjusting the respective adjustable support members as to their individual longitudinal dimensions.

12. A support apparatus as claimed in claim 11 wherein a base member is pivotally mounted on the first end of each of the adjustable support members and which includes a resilient member which is adapted to engage the transom of the watercraft.

13. A support apparatus as claimed in claim 11 wherein the securing means includes a substantially U-shaped frame having a pair of legs, and wherein one of the legs is fixed on the second end of each of the support members, and wherein a threaded member is threadably received through the other leg and is operable to engage the windscreen thereby capturing the windscreen between the threaded member and the second end of each of the support members.

14. A support apparatus as claimed in claim 12 wherein the yoke has an elongated main body with a bottom edge and left and right portions, and wherein first, second and third apertures are defined by the main body and which extend through the bottom edge, and wherein the first and third apertures are located in the left and right portion respectively and wherein the first and third apertures include a substantially vertically disposed component, and a substantially horizontally disposed component, the horizontally disposed component of the respective first and third apertures positioned in an outwardly disposed direction, and wherein the horizontally disposed components each include an arcuately shaped seat, and wherein the second aperture is positioned substantially centrally of the main body and has a substantially vertically disposed component.

15. A support apparatus as claimed in claim 13 wherein the yoke is adjustable as to length and has a central portion which is adapted telescopingly to receive a pair of extendable legs, and wherein the extendable legs each have a proximal end which is slidably received in substantially telescoping relation relative to the central portion, and a distal end, and wherein an engagement member is mounted on the distal end of each of the extendable legs and substantially centrally of the central portion, the engagement members operable to releasably engage the individual support members, thereby positioning the support members in predetermined spaced relation, and wherein securing means is borne by the central portion and is operable to releasably position said respective extendable legs in predetermined fixed longitudinal relation relative to the central portion.

16. A support apparatus as claimed in claim 13 wherein the yoke includes a pair of adjustable leg members each having a substantially cylindrically shaped first portion with respective proximal and distal ends, and wherein a pair of substantially cylindrically shaped second portions individually telescopingly mate with each of the first portions, and wherein a pair of substantially cylindrically shaped bracing members individually telescopingly mate with each of the second portions, and wherein the respective proximal ends of the first portions are pivotally joined together at a pivot point, and wherein individual engagement members are individually mounted on the second portion of each of the adjustable legs and at the pivot point, and wherein an articulation adjustment means is borne by the yoke and is operable to releasably position the respective adjustable leg members in a predetermined fixed attitude relative one to the other, and wherein securing means is borne by each of the leg members and is operable to releasably position the respective second portions and bracing members in predetermined fixed substantially longitudinally extending relation relative to the associated first and second portions.

17. A support apparatus as claimed in claim 15 wherein the securing means includes a pair of thumb screws which are threadably received through the central portion and which respectively engage the individual extendable legs thereby releasably securing them in predetermined fixed longitudinally extending relation relative to the central portion.

18. A support apparatus as claimed in claim 16 wherein the articulation adjustment means includes a threaded post about which the individual adjustable leg members pivot and a hand adjustable nut member threadably engages the threaded post thereby securing the individual adjustable legs in a predetermined fixed attitude one to the other, and wherein the securing means includes a pair of thumb screws which are individually threadably received through each of the first and second portions and which individually engage the second portions and the bracing members thereby releasably securing the individual second portions and bracing members in predetermined fixed longitudinally extending relation relative to the associated first and second portions.

* * * * *

UNITED STATES PATENT AND TRADEMARK OFFICE

CERTIFICATE OF CORRECTION

PATENT NO. : 4,979,457

DATED : December 25, 1990

INVENTOR(S) : Peter M. Sommerhauser, et al

It is certified that error appears in the above-identified patent and that said Letters Patent is hereby corrected as shown below:

Column 1, Line 60, after "boat" delete the parenthesis -- ")" --;

Column 4, Line 47, cancel "seCond" and insert -- second --;

Column 10, Line 34, cancel "claim 3" and insert -- claim 1--.

Signed and Sealed this

Twenty-first Day of April, 1992

*Attest:*

HARRY F. MANBECK, JR.

*Attesting Officer*

*Commissioner of Patents and Trademarks*